US009415500B2

(12) United States Patent
Billado, Jr.

(10) Patent No.: US 9,415,500 B2
(45) Date of Patent: Aug. 16, 2016

(54) BI-DIRECTIONAL GRIP STRUCTURE

(71) Applicant: Harry S. Billado, Jr., Newbury, NH (US)

(72) Inventor: Harry S. Billado, Jr., Newbury, NH (US)

(73) Assignee: GBH PRODUCTS, LLC, Kingston, MA (US)

( * ) Notice: Subject to any disclaimer, the term of this patent is extended or adjusted under 35 U.S.C. 154(b) by 0 days.

(21) Appl. No.: 14/211,667

(22) Filed: Mar. 14, 2014

(65) Prior Publication Data

US 2014/0366331 A1 Dec. 18, 2014

Related U.S. Application Data

(60) Provisional application No. 61/800,977, filed on Mar. 15, 2013.

(51) Int. Cl.
*B25G 1/10* (2006.01)

(52) U.S. Cl.
CPC *B25G 1/102* (2013.01); *B25G 1/10* (2013.01); *Y10T 16/476* (2015.01)

(58) Field of Classification Search
CPC ..... B25G 1/10; B25G 1/102; Y10T 16/466; Y10T 16/476; Y10S 16/12
See application file for complete search history.

(56) References Cited

U.S. PATENT DOCUMENTS 862,412 A * 8/1907 Partridge ..... 152/167
2,180,649 A * 11/1939 White ..... 152/209.5
2,240,542 A * 5/1941 Bourdon ..... 152/209.15
3,932,950 A * 1/1976 Taber ..... 36/59 R
4,308,762 A * 1/1982 Jannard ..... 74/551.9
5,097,566 A * 3/1992 Decker et al. ..... 16/421
5,261,665 A * 11/1993 Downey ..... 473/303
5,491,015 A * 2/1996 Reeves et al. ..... 428/167
5,508,084 A * 4/1996 Reeves et al. ..... 428/172
5,689,890 A 11/1997 Glesser
5,891,549 A * 4/1999 Beretta et al. ..... 428/100
5,983,506 A * 11/1999 Glesser ..... 30/340
6,076,283 A * 6/2000 Boie ..... 36/59 C
6,266,840 B1 * 7/2001 Munro ..... 15/167.1
6,374,417 B1 * 4/2002 Stagnitta ..... 2/161.8
6,431,234 B1 * 8/2002 Gast et al. ..... 152/209.15
6,836,977 B2 * 1/2005 Larson et al. ..... 36/59 R
6,860,053 B2 * 3/2005 Christiansen ..... 42/71.02
7,625,625 B2 * 12/2009 Rios et al. ..... 428/141
7,703,179 B2 * 4/2010 Ferguson et al. ..... 16/431
7,862,446 B2 1/2011 Huang
8,225,427 B2 * 7/2012 Bevier ..... 2/161.6
8,389,102 B2 * 3/2013 Sikora et al. ..... 428/141
2003/0195065 A1 * 10/2003 Davis ..... 473/549
2004/0093979 A1 * 5/2004 Rosenthal ..... 74/551.9
2005/0055835 A1 * 3/2005 Pardue et al. ..... 30/340
2007/0082750 A1 * 4/2007 Rose ..... 473/300
2009/0162596 A1 * 6/2009 Rios et al. ..... 428/45
2009/0162651 A1 * 6/2009 Rios et al. ..... 428/354
2010/0325901 A1 * 12/2010 Catalano et al. ..... 30/340

(Continued)

OTHER PUBLICATIONS

Accumark Pencil Blade; For Immediate Release on Dec. 21, 2002; "Introducting the Ultimate Carpenter's Pencil for Contractors."

*Primary Examiner* — Jeffrey O Brien
(74) *Attorney, Agent, or Firm* — Grossman, Tucker, Perreault & Pfleger, PLLC

(57) ABSTRACT

A bi-directional grip structure and hand tool incorporating the same. The structure includes a base and first and second sets of protrusions. The first and second sets of protrusions include inclined surfaces positioned in opposing directions.

3 Claims, 3 Drawing Sheets

(56) References Cited

U.S. PATENT DOCUMENTS

2011/0030121 A1* 2/2011 Smalls ..... 2/161.7
2011/0311771 A1* 12/2011 Sikora et al. ..... 428/141
2012/0027990 A1* 2/2012 Kobe et al. ..... 428/119
2013/0175067 A1* 7/2013 Parel ..... 173/170

* cited by examiner

BI-DIRECTIONAL GRIP STRUCTURE

CROSS REFERENCE TO RELATED APPLICATIONS

The present application claims the benefit of the filing date of U.S. Provisional Application Ser. No. 61/800,977, filed, Mar. 15, 2013, the entire teachings of which are hereby incorporated herein by reference.

TECHNICAL FIELD

The present disclosure relates to gripping features, and, more particularly, to a bi-directional grip structure for hand-held articles.

BACKGROUND

Hand-held articles, such as knives, hammers, or other tools, typically include a working portion (e.g. a blade) and a handle portion that is adapted to be gripped by the hand of a user so that the working portion can be manipulated. One problem associated with such articles is that slippage of the article can occur when excessive force is applied by the user to the article or when the user's grip on a portion of the article, such as the handle, loosens. Such slippage can seriously injure the user or others in the vicinity of the user. Some hand-held articles are adapted to reduce slippage in one direction or have a uniform surface pattern to reduce slippage equally in all directions without consideration of the direction of applied force. However, some designs are not well suited to adequately reduce slippage in multiple directions, e.g., both the forward and backward directions.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

Figure 1:
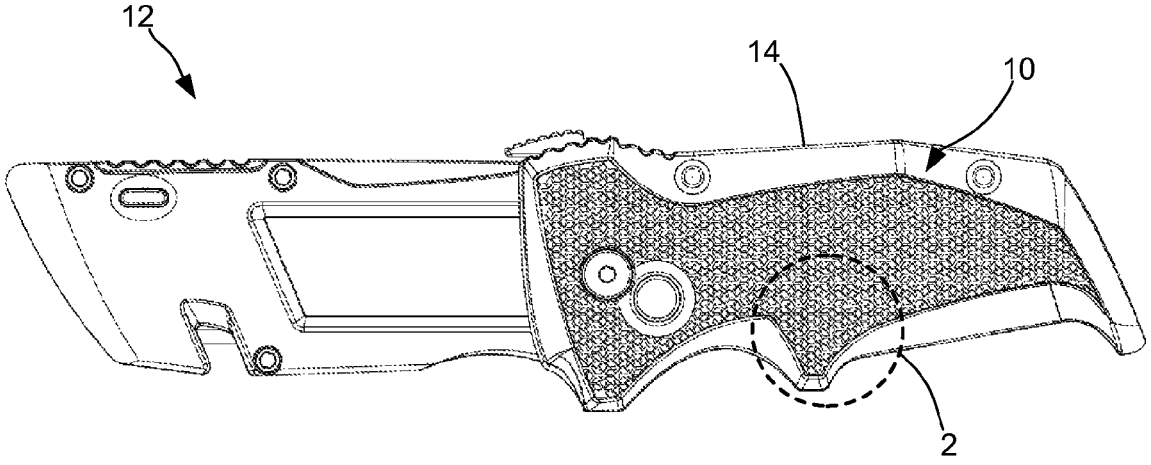
FIG. 1 is a side view of one embodiment of a bi-directional grip structure on a handle portion of a utility knife consistent with the present disclosure.

FIG. 1 illustrates a side view of a utility knife 12 having one embodiment of a bi-directional grip structure 10 consistent with the present disclosure. As shown, the grip structure 10 is covering the handle portion 14 of the knife. As described in greater detail herein, the bi-directional grip structure 10 is configured to reduce slippage of a users's hand while the user is utilizing a hand-held article, such as, for example, the utility knife 10.

It should be noted that, although the bi-directional grip structure consistent 10 with the present disclosure is described with respect to a particular type of tool, specifically a knife, it should be appreciated that references to a knife are for illustrative purposes to describe bi-directional grip structure of the present disclosure. Those of ordinary skill in the art will appreciate that the bi-directional grip structure of the present disclosure is not limited to knives and may be included on all type of hand-held articles, including tools, sports equipment, and the like, as well as any other article that allows a user to grasp a portion thereof, such as, for example, a steering wheel.

Figure 2:
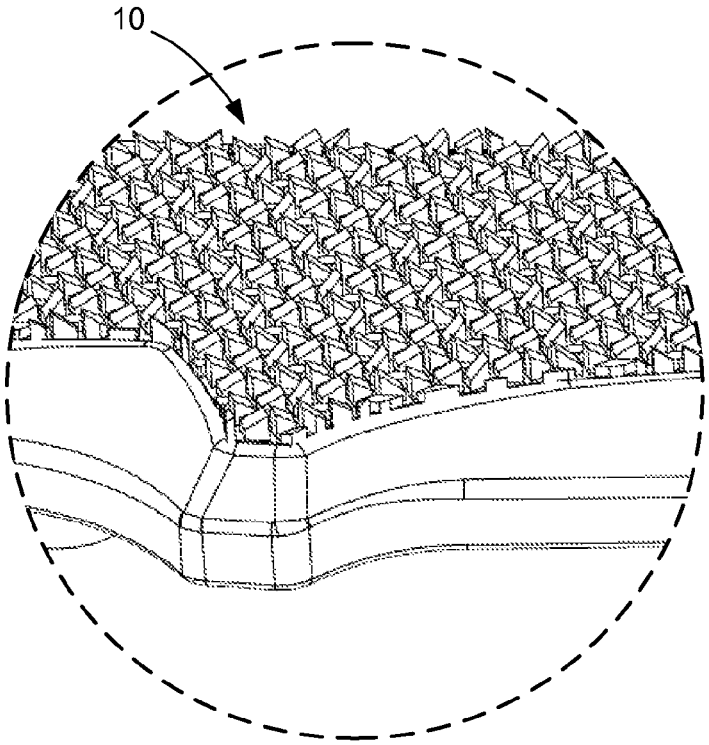
FIG. 2 is an enlarged perspective view of a portion of the knife handle of FIG. 1 illustrating the bi-directional grip structure in greater detail.
Figure 3:
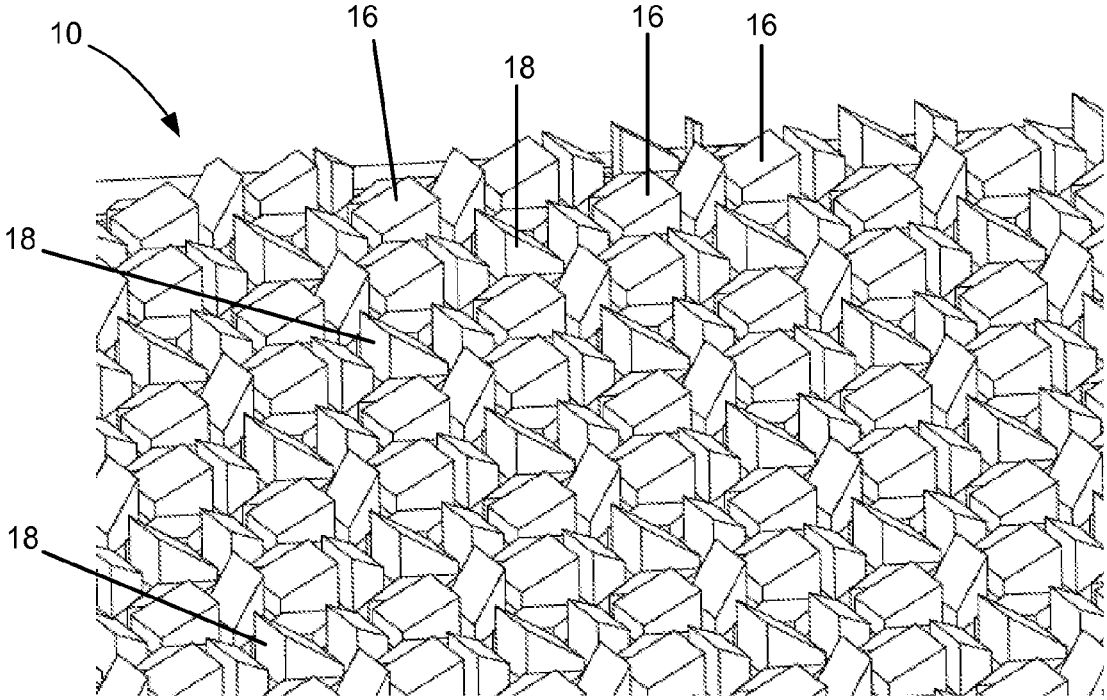
FIG. 3 is a enlarged perspective view of the bi-directional grip structure consistent with the present disclosure.

FIG. 2 is an enlarged perspective view of a portion of the knife handle 14 of FIG. 1 and FIG. 3 is an enlarged perspective view of the bi-directional grip structure of FIG. 2 illustrating the bi-directional grip structure 10 in greater detail. As shown, the grip structure 10 generally includes a plurality of discrete protrusions extending away from a base 20 (shown in FIG. 4). More specifically, the grip structure 10 generally includes a first set of discrete protrusions 16 and a second set of discrete protrusions 18 mixed with one another positioned throughout the entire base 20 of the grip structure 10. For example, as most clearly shown in FIG. 3, the first and second sets of protrusions 16, 18 are positioned across the entire surface of the knife handle 14 rather than being separated from each other on opposing ends of the knife handle 14. In one embodiment, the grip structure 10 may have a pattern in which a protrusion from the first set 16 is positioned adjacent to a protrusion from the second set 18 in an alternating fashion.

Each of the discrete protrusions of the first set 16 is shaped and/or sized to provide friction against an object (e.g. user's hand) in a first direction to prevent slippage in that direction. Similarly, each of the discrete protrusions of the second set 18 is shaped and/or sized to provide friction against an object in a second direction to prevent slippage in that direction, wherein the second direction may oppose the first direction.

For example, in the instance of a knife, a user may use a back and forth movement when cutting an item. As such, the user's hand moves with a forward motion and then a backward motion. In this instance, the first set of discrete protrusions 16 may be configured to provide friction against the user's hand when the user is making a forward motion, thereby preventing slippage in the forward direction. In this example, the second set of discrete protrusions 18 may be configured to provide friction against the user's hand when the user makes a backward motion, thereby preventing slippage in the backward direction. Accordingly, the grip structure 10 provides grip to the user in at least two directions.

Accordingly, a bi-directional grip structure consistent with the present disclosure may be applied to any product that uses a handle, wherein the motion required to use the product or is a forward and backward motion. Such products may include, for example, a toothbrush or hand saw. Additionally, the bi-directional grip structure 10 may be utilized in any product that uses a forward motion some of the time and then a backward motion some of the time. Such products may include, for example, a shovel, turf edger (long handle or "D-grip" (dig in and pull out)), hammer (swing to hit nail, reverse motion to pull nail), steering wheel grip (turn right/turn left), wheel barrow, baby stroller (push & pull), etc.

Figure 4:
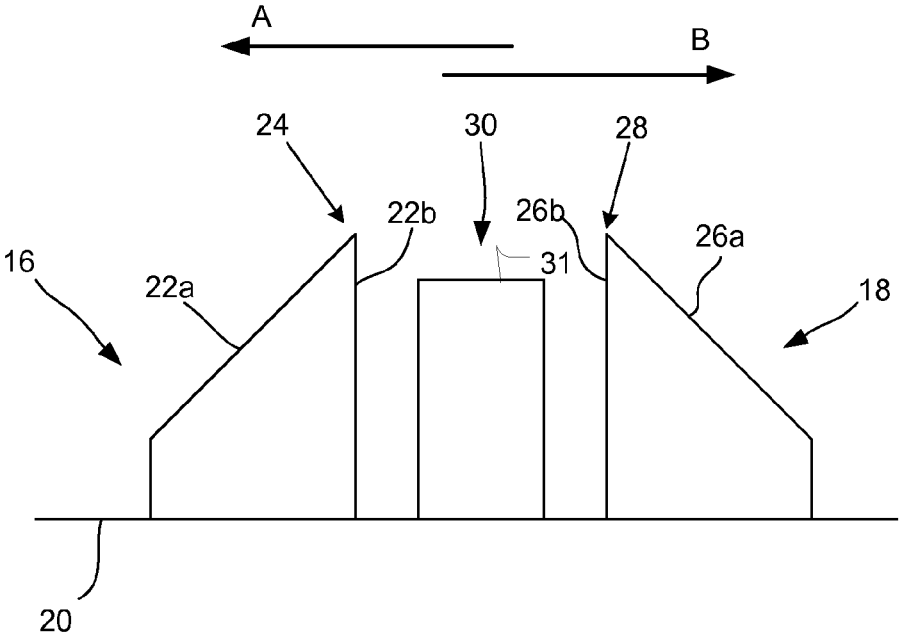
FIG. 4 is a side cross-sectional view of a portion of the bi-directional grip structure consistent with the present disclosure.

FIG. 4 is a side cross-sectional view of a portion of the bi-directional grip structure 10 consistent with the present disclosure. As shown, the protrusions of the first and second sets 16, 18 extend away from a base 20. In the illustrated embodiment, a protrusion of the first set 16 has a first surface 22*a* and a second surface 22*b* intersecting one another and defining an apex 24. The first surface 22*a* is generally angled in a first direction relative to the second surface 22*b*. In particular, the second surface 22*b* is generally perpendicular with the base 20 and the first surface 22*a* extends from the base 20 at an inclined angle, generally forming an acute included angle with the second surface 22*b* and forming the apex 26. Accordingly, a protrusion of the first set 16 is generally angled in the first direction.

A protrusion of the second set 18 is similarly configured as a protrusion of the first set 16 but is angled in the opposing second direction. As shown, the protrusion of the second set 18 has a first surface 26*a* and a second surface 26*b* intersecting one another and defining an apex 28. The first surface 26*a* is generally angled in a second direction relative to the second surface 26*b*. In particular, the second surface 26*b* is generally perpendicular with the base 20 and the first surface 26*a* extends from the base 20 at an inclined angle, generally forming an acute included angle with the second surface 26*b* and forming the apex 28. Accordingly, a protrusion of the second set 18 is generally angled in the second direction and generally opposing a protrusion of the first set 16. Also, the second surface 22*b* of each of the first set of protrusions 16 may be positioned in an opposed facing relationship to the second surface 26*b* of an associated one of the second set of protrusions 18.

When a user makes a forward motion, the user's hand will generally apply a force (indicated by arrow A) against protrusions of both the first and second sets 16, 18. When moving in the forward direction, the user's hand may easily slide along the first surface 26*a* of the protrusions of the second set 18, as the first surface 26*a* is at an incline and generally does not provide friction against the user's hand during a forward motion. However, the apex 24 of a protrusion of the first set 16 will generally provide friction against the user's hand, thereby preventing slippage in the forward motion.

When a user makes a backward motion, the user's hand will generally apply a force (indicated by arrow B) against protrusions of both the first and second sets 16, 18. In this instance, the user's hand may easily slide along the first surface 22*a* of the protrusions of the first set 16, as the first surface 22*a* is at an incline and generally does not provide friction against the user's hand during a backward motion. However, the apex 28 of a protrusion of the second set 18 will generally provide friction against the user's hand, thereby preventing slippage in the backward direction. In addition to the protrusions of the first and second sets 16, 18, the grip structure 10 may also include non-directional discrete protrusions 30, which may allow for more separation between protrusions of each of the first and second sets 16, 18. Each of the non-directional discrete protrusions 30 may have a flat top surface 31 positioned between the base 20 and the apexes 24, 28 of the protrusions of the first and second sets 16, 18.

Figure 5:
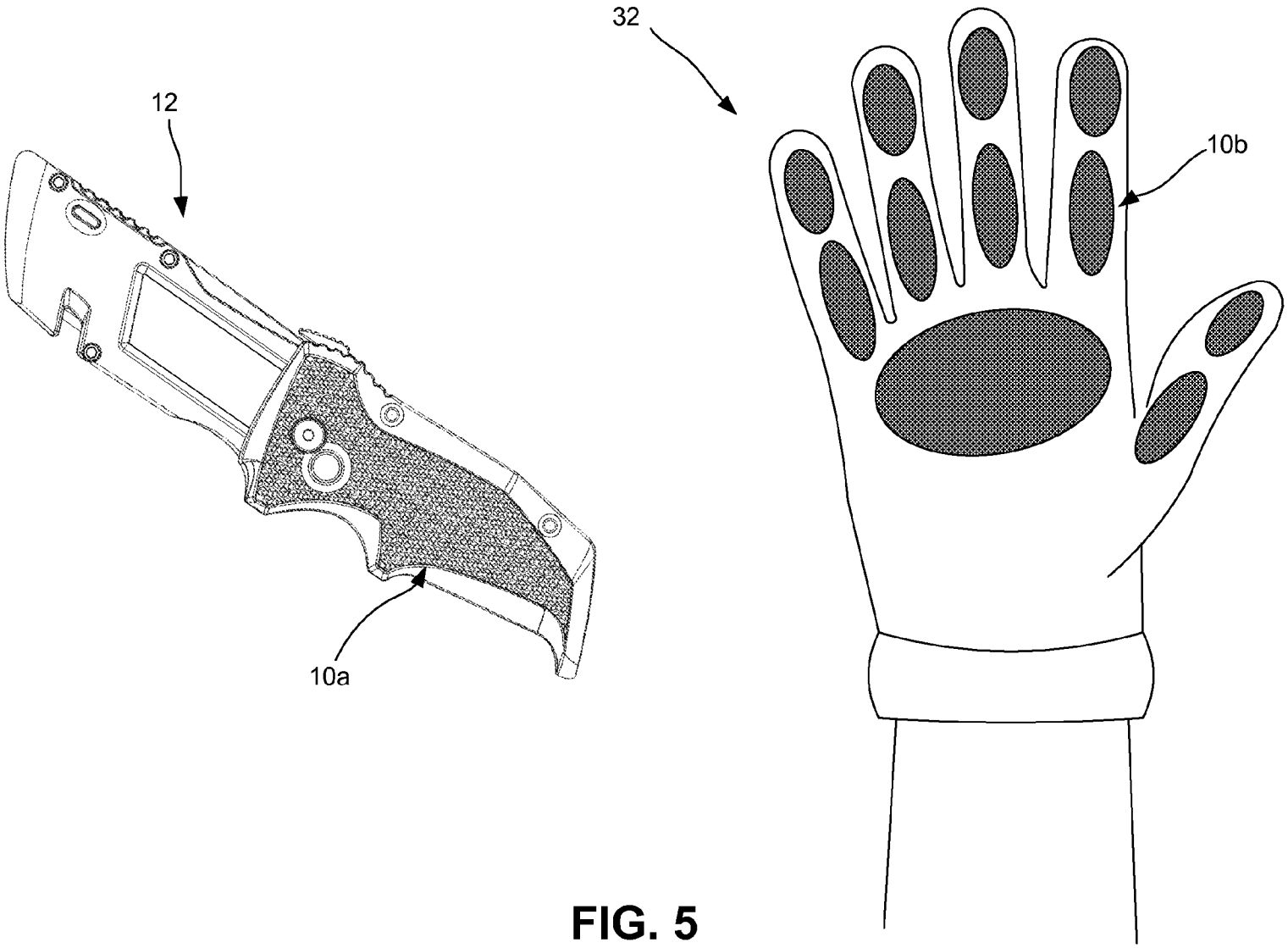
FIG. 5 illustrates another article having a bi-directional grip structure consistent with the present disclosure.

FIG. 5 illustrates another article, specifically a glove 32, having a bi-directional grip structure 10*b* consistent with the present disclosure. As previously described, other hand-held articles and products having handles or allowing a user grasp may include bi-directional grip structure consistent with the present disclosure. In addition, other articles, such as a glove 32, may include a bi-directional grip structure 10*b* and may be used to cooperate with the bi-directional grip structure 10*a* of another article, such as the knife 12 of FIG. 1, thereby providing increased grip for the user. In this instance, the grip structure 10*a* of the knife 12, specifically each of the protrusions of the first and second sets 16, 18 may correspond to the protrusions of the first and second sets 16, 18 of the grip structure 10*b* of the glove 32 and matingly engage one another.

According to one aspect of the disclosure, there is thus provided a bi-directional grip structure including a base; a first set of protrusions extending away from the base, each protrusion of the first set of protrusions comprising a first surface and a second surface, the first surface extending in a first direction at an inclined angle to form an acute included angle with the second surface, the second surface extending substantially perpendicularly to the base; and a second set of protrusions extending away from the base, each protrusion of the second set of protrusions comprising a first surface and a second surface, the first surface extending in a second direction at an inclined angle to form an acute included angle with the second surface, the second surface extending substantially perpendicularly to the base, wherein the first direction and the second direction are opposing directions. A hand tool with a bi-directional grip structure disposed on a handle of the hand tool is also provided.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A hand tool comprising:

a handle portion; and a bi-directional grip structure disposed on the handle portion, the bi-directional grip structure comprising:

a base, a first set of protrusions extending away from the base, each protrusion of the first set of protrusions comprising:

a first surface, a second surface, and a third surface, the first surface having a first end and a second end, the first end extending in a first direction at an inclined angle to form an acute included angle with the second surface at the second end, the second surface extending to the base and being substantially perpendicular to the base, the first end also forming an included angle with the third surface, with the third surface extending to the base, and a second set of protrusions extending away from the base, each protrusion of the second set of protrusions comprising:

a first surface, a second surface, and a third surface, the first surface having a first end and a second end, the first end extending in a second direction at an inclined angle to form an acute included angle with the second surface at the second end, the second surface extending to the base and being substantially perpendicular to the base, the first end also forming an included angle with the third surface, with the third surface extending to the base, a plurality of non-directional protrusions, each of the non-directional protrusions positioned between associated ones of the first and second sets of protrusions;

wherein the first direction and the second direction are opposing directions, and wherein a given protrusion of the first set of protrusions is separated from an adjacent protrusion of the second set of protrusions by a substantially flat surface of the base; and wherein the second surface of each protrusion of the first set of protrusions is positioned in opposed facing relationship to the second surface of an associated protrusion of the second set of protrusions.

2. The hand tool of claim 1, wherein the first surface and second surface of each protrusion of the first set of protrusions intersect to define a first protrusion apex, and the first surface and second surface of each protrusion of the second set of protrusions intersect to define a second protrusion apex.

3. The hand tool of claim 1, wherein each of the non-directional protrusions includes a flat-top surface, the flat-top surface defining a line that extends generally parallel to the base.

* * * * *